United States Patent [19]

Ochs

[11] Patent Number: 4,716,708

[45] Date of Patent: Jan. 5, 1988

[54] MEANS FOR SEALING CONTAINERS

[75] Inventor: Charles S. Ochs, Lancaster, Ohio

[73] Assignee: Anchor Hocking Corporation, Lancaster, Ohio

[21] Appl. No.: 852,037

[22] Filed: Apr. 14, 1986

[51] Int. Cl.[4] ..... B65B 7/28

[52] U.S. Cl. ..... 53/314; 53/315; 29/773

[58] Field of Search ..... 29/429, 773; 53/306, 53/310, 313, 315

[56] References Cited

U.S. PATENT DOCUMENTS 3,179,237 4/1965 Ninneman ..... 53/313

3,987,535 10/1976 Brown ..... 29/773 X 4,279,115 7/1981 Roberts et al. ..... 53/314

*Primary Examiner*—Charles Hart

*Attorney, Agent, or Firm*—Stoll, Wilkie, Previto & Hoffman

[57] ABSTRACT

Improved means are described for sealing thin-walled and relatively flexible containers. The improvements are made in straight line sealing machines which include side belt arrangements which encapsulate the filled containers and which also provide means for heating and then for pressing on and for twisting composite closure caps into a finally sealed position on the encapsulated containers.

12 Claims, 10 Drawing Figures

Fig. 3.
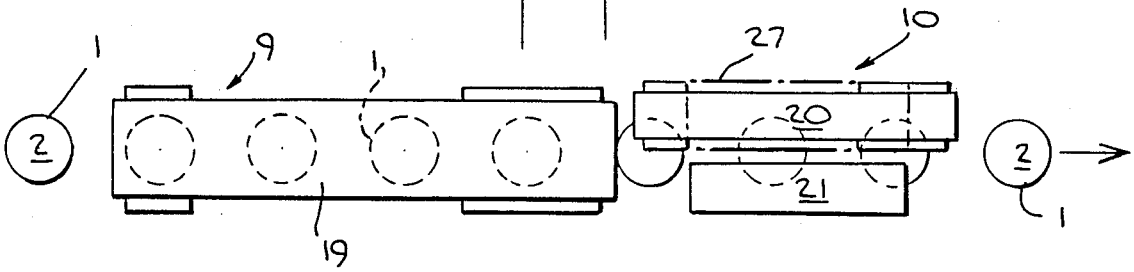
Fig. 5.
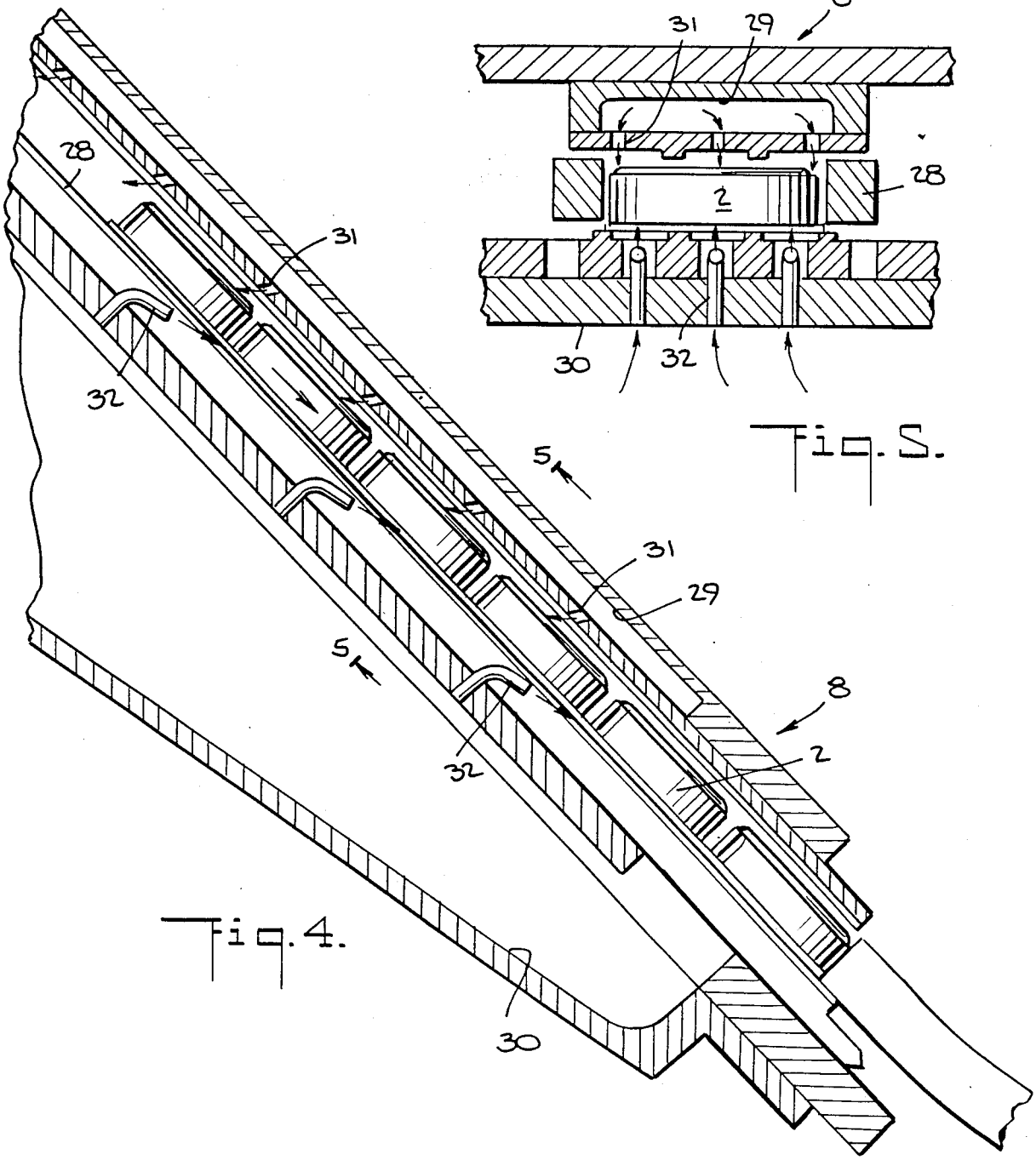
Fig. 4.

MEANS FOR SEALING CONTAINERS

BACKGROUND OF THE INVENTION

The present invention relates to a means for sealing containers at high speed with closure caps. More particularly, it relates to improvements in a method and means for moving hollow thin-walled relatively flexible containers through a straight line sealing machine and for applying and sealing closure caps onto the moving containers.

The high speed sealing of containers by a method which uses a straight line sealing machine is well known. In these machines, the filled containers are carried along in a straight line beneath a cap applying means which lightly places a closure cap on each moving container top. Thereafter, the jars are moved beneath a sealing means which tightly seals the closure cap to the moving containers. Prior methods and machines of this general type have been used with relatively rigid glass or other containers and they have applied the closure caps with either a press on motion, or alternatively, a rotary motion such as by applying a threaded closure to a threaded container top.

The improvements of the present means provide for the high speed sealing of relatively thin-walled and flexible containers. In normal sealing machinery such containers would be distorted by the sealing mechanism thereby causing the sealed container to be discharged with permanently distorted walls or with unacceptable variations in the sealed package, particularly for vacuum sealed containers.

Additionally, the method and means of the present invention provides for a high speed sealing of thin-walled containers by applying the closure caps with a significant press on motion of the closure cap downwardly over the container threads or lugs plus a final and limited rotary or twisting movement of the closure caps. This composite sealing movement, as well as the use of tamper evident composite closures having container gripping bands, has been facilitated by a combination of a closure softening means in the cap applying mechanism.

Accordingly, as object of the present invention is to provide an improved straight line method and means for sealing containers.

Another object of the present invention is to provide an improved straight line method and means for sealing thin-walled containers.

Another object of the present invention is to provide an improved container gripping method and means for a straight line container sealing machine.

Another object of the present invention is to provide an improved composite motion sealing means for closure caps.

Another object of the present invention is to provide an improved combination of means for heat softening and sealing composite plastic and metal closure caps.

Other and further objects of the present invention will become apparent upon an undestanding of the illustrative embodiments about to be described, or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification wherein:

FIG. 3 is a diagramatic plan view of the composite sealing mechanism in accordance with the present invention.

FIG. 4 is an enlarged detailed sectional view of a cap feed chute in accordance with the present invention.

FIG. 5 is a sectional view of the cap chute taken along line 5—5 on FIG. 4.

DESCRIPTION OF THE PREFERRED EMBODIMENT

Figure 1:
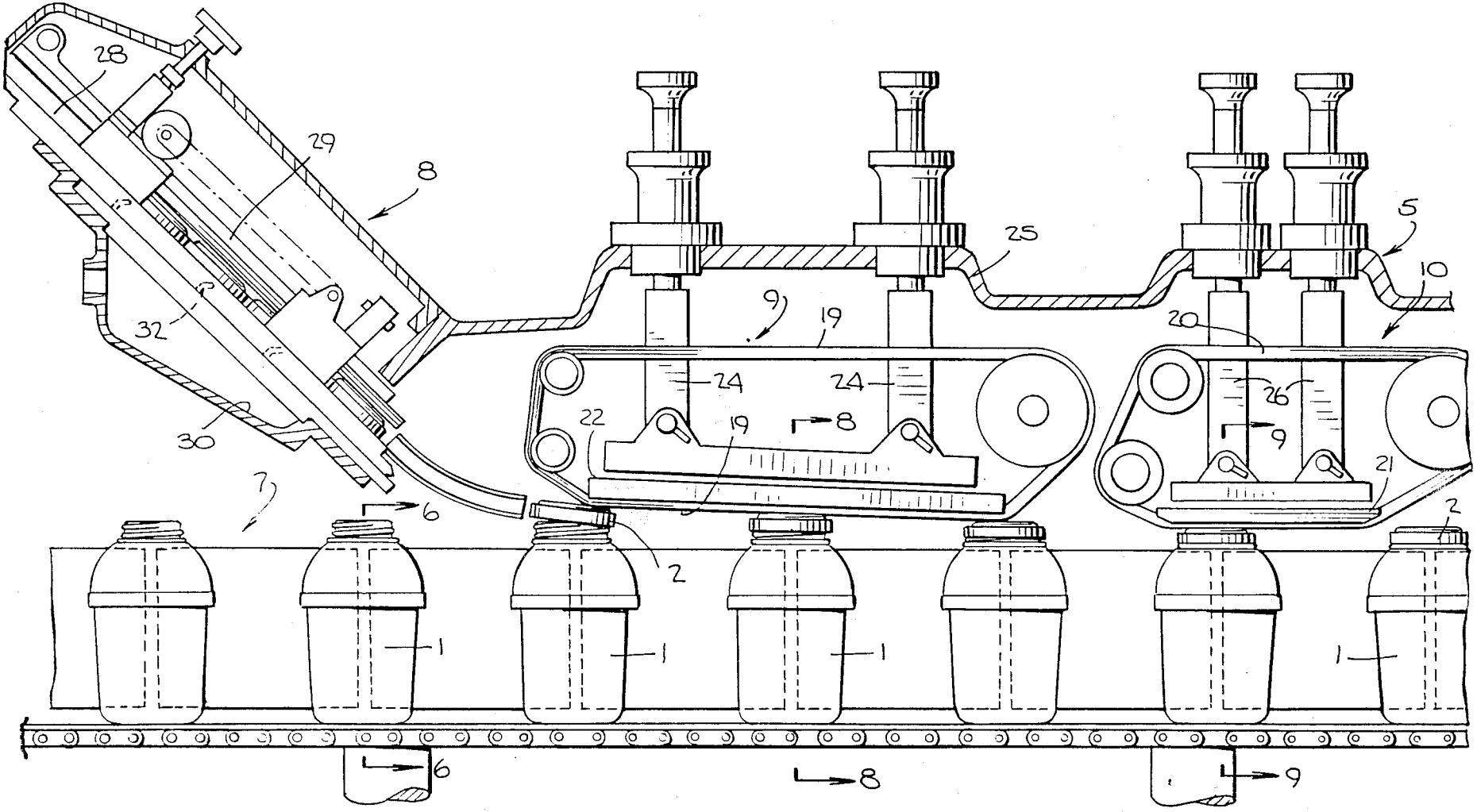
FIG. 1 is a front view partially in section of the sealing method and means of the present invention.

The method and means of the present invention are particularly useful for thin-walled and relatively flexible containers such as the jar or container 1 illustrated in FIGS. 6 thru 10. Such containers may be formed in one or more sections and the sections themselves may be vacuum formed from relatively thin plastic sheets or molded with relatively thin side walls and with the necessary rims and threads.

The containers 1 are sealed with closure caps 2 which may be metal CT caps or molded plastic caps, or composite caps having a molded plastic ring 3 and a metal cover 4 contained within the ring 3. Where the elements to attach the closures to the jars are threads or lugs, these threads or lugs may be shaped to facilitate an initial press-on sealing action whereby the threads of the closure are pressed over at least a portion of the cooperating container threads.

Figure 2:
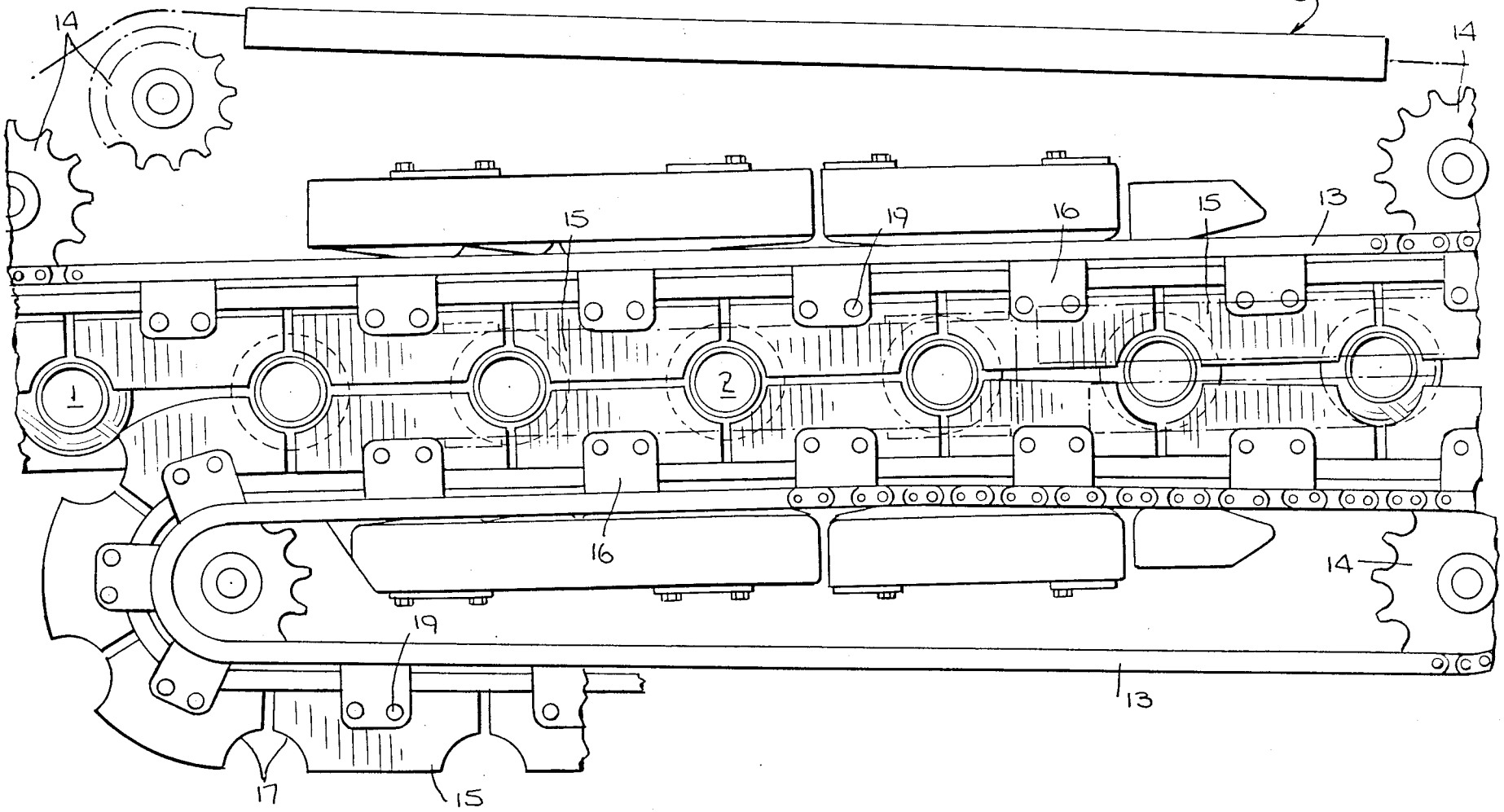
FIG. 2 is a top plan view of the method and means of FIG. 1.
Figure 6:
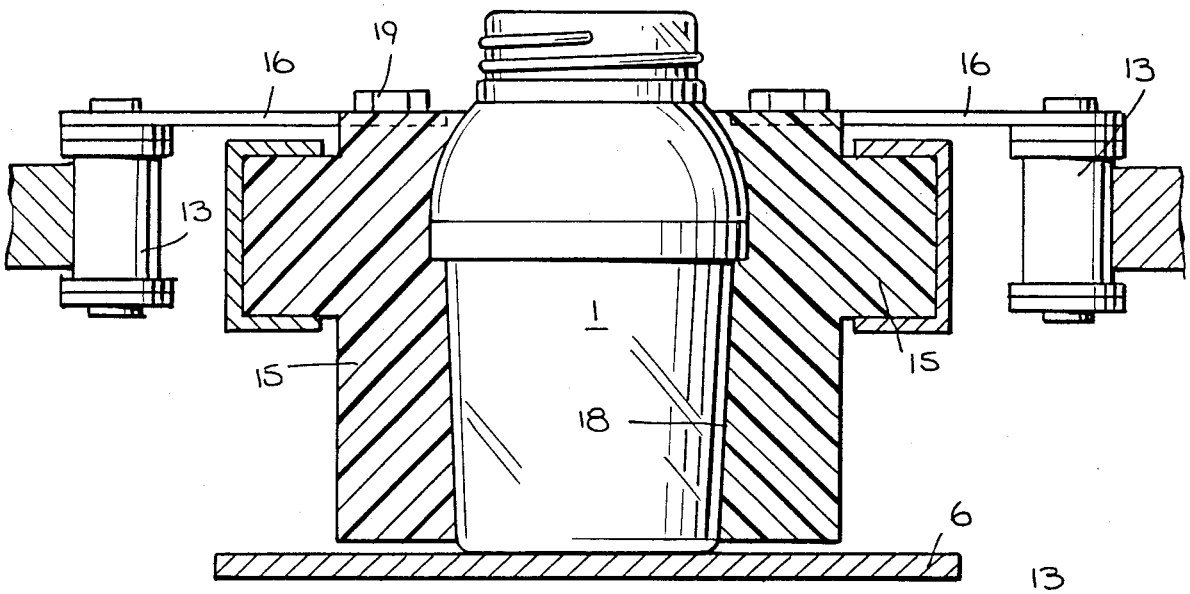
FIG. 6 is a vertical sectional view taken along line 6—6 on FIG. 1.

FIGS. 1 and 2 illustrate themethod and means in accordance with the present invention as incorporated in a straight line sealing machine 5. In straight line sealing operations, the containers 1 are carried in a line on a conveyor 6 between side belts 7 past a cap applying chute 8 and then a sealing means, which in the illustrated apparatus, comprises an initial press-on sealing means 9 and thereafter a cap rotating means 10. The press-on sealing means 9 presses the caps 2 downwardly over the container 1 finish 11 (FIG. 8) to perform a substantial portion of the sealing by engaging the closure and jar threads and the final sealing means thereafter rotates the cap 2 a fraction of a turn to complete the final seal.

Straight line sealing machines of this general type are known, as for example, in issued U.S. Pat. Nos. 3,274,748, dated Sept. 27, 1966; 3,438,174, dated Apr. 15, 1969; and 4,279,115, dated July 21, 1981. The machine described herein has a base, which may be similar to one of those of the above patents, supporting the endless jar conveyor 6 and with appropriate feed means which feeds the jars 1 continuously onto the upper level surface of the conveyor 6.

As already indicated, the machine and method of the present invention are adapted for working with relatively thin-walled and flexible containers. The side belt mechanisms of prior machines, such as those identified above, each included side belts for positioning the jars on the conveyor at the proper spacing and for guiding the jars through the cap applying and sealing means.

Figure 7:
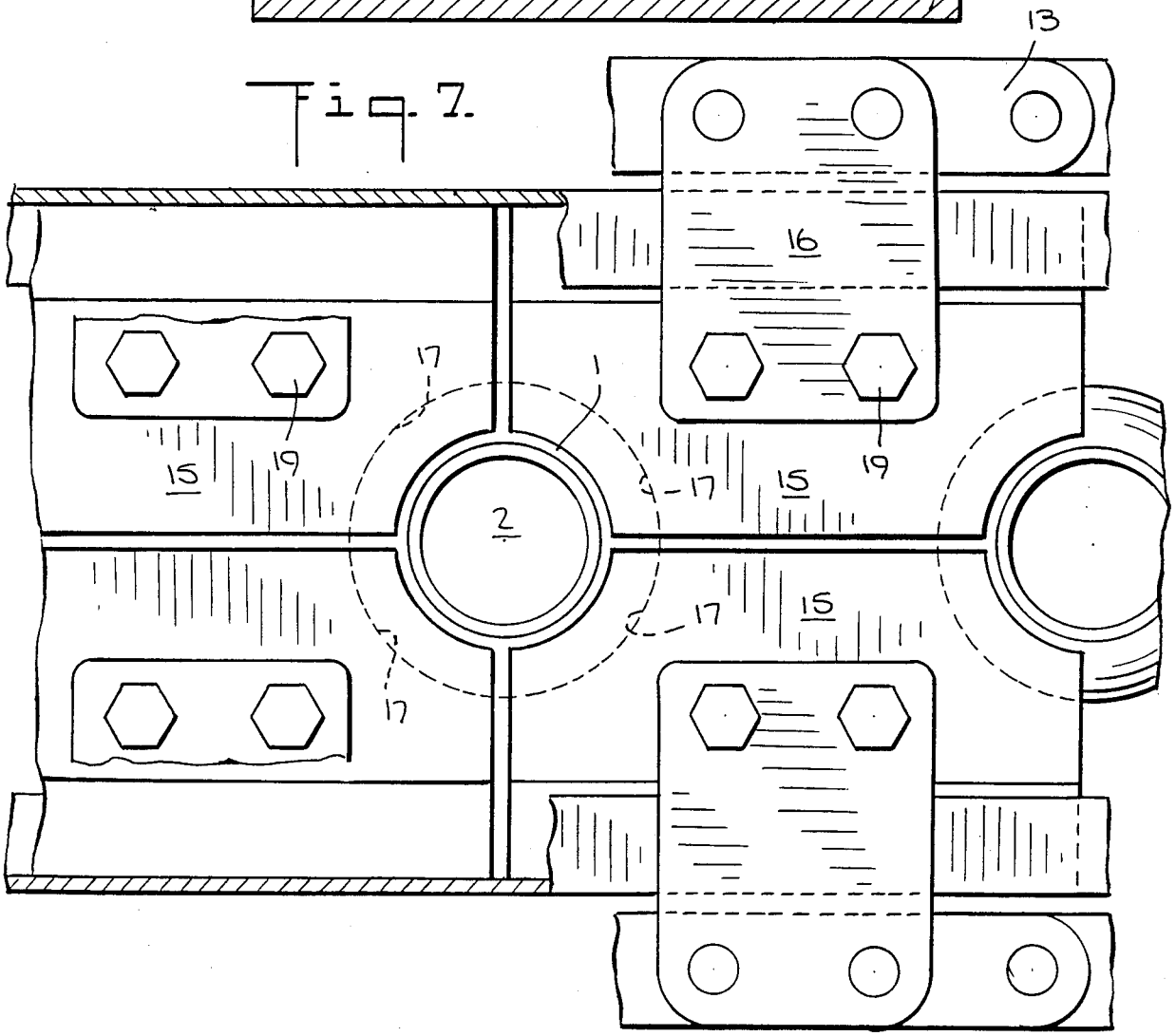
FIG. 7 is an enlarged top plan view of the container gripping chain in accordance with the present invention.
Figure 8:
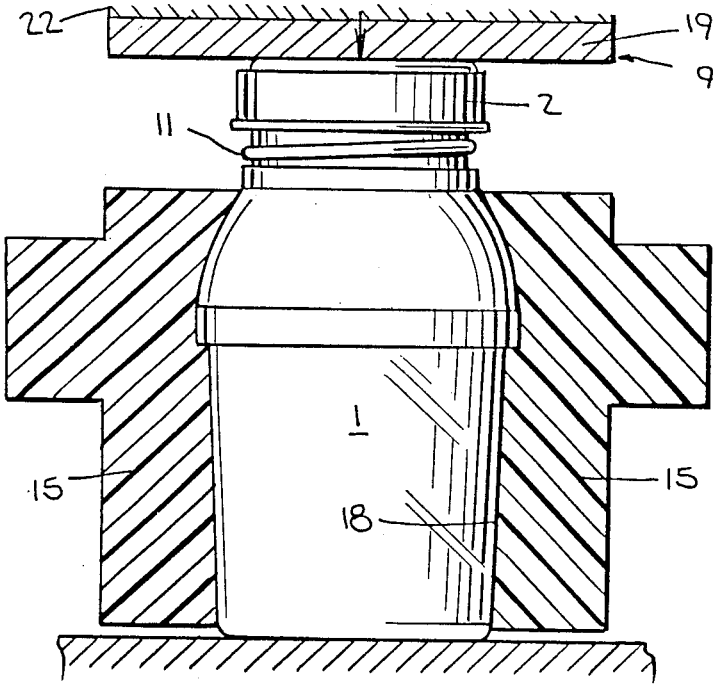
FIGS. 8 and 9 are vertical sectional views taken along lines 8—8 and 9—9 on FIG. 1.

An improved side belt 7 is provided in the present machines which is illustrated in FIGS. 1 and 2 as well as FIGS. 6 thru 10. The side belt 7, in accordance with the invention, includes endless metal roller chains 13 mounted on front and rear chain driving and guiding sprockets 14. Each of the chains 13 has a series of jar pockets 15 attached to the chain 13 by brackets 16 (FIG. 7) in side by side position so that the cooperating pockets 15 may move freely along with the endless chains 13 and will form closed jar encapsulating means between the facing runs of the two chains 13.(FIGS. 1, 2 and 7). A preferred embodiment of the jar pockets 15 comprises a plastic or metal molded and/or machined element with a quarter section of each jar 1 formed as a cavity 17 on opposite pocket 15 ends. As illustrated in FIG. 7, four adjacent pockets 15, i.e. two facing pockets on opposite sides of the conveyor 6 cooperate to form a single jar encapsulating cavity 18 FIG. 6) which provides full support for the principal portions of the jar 1 being sealed.

It is preferred that the cavity 18 formed by the four cooperating pockets 15 conform exactly to the outer dimensions of the jar 1 being sealed so that the cavity 18 provides a full support resisting any deformation of the jar 1 by downward sealing or by other pressures as the jar 1 passes through the sealing machine 5. Additionally, the support of the jars 1 prevents a sagging of the heated plastic jars such as occurs with heated but unsupported jars 1.

Alternatively, and depending upon the particular jar shape, jar pockets may be provided having a full half section of each jar formed at about the middle of one side so that only two facing jar pockets cooperate to carry an encapsulated jar through the cap applying and sealing positions. The jar pockets 15 are removably attached to the chain brackets 16 by simple bolts 19 or other fasteners permitting the jar pockets 15 to be changed for differing jar shapes and sizes.

As described in the above cited prior patents, the jar conveyor 6, the side belt 7 driving means, as well as the moving portions of the sealing means 9 and 10, are coupled together and synchronized generally by being driven from a single drive motor (not shown).

Figure 10:
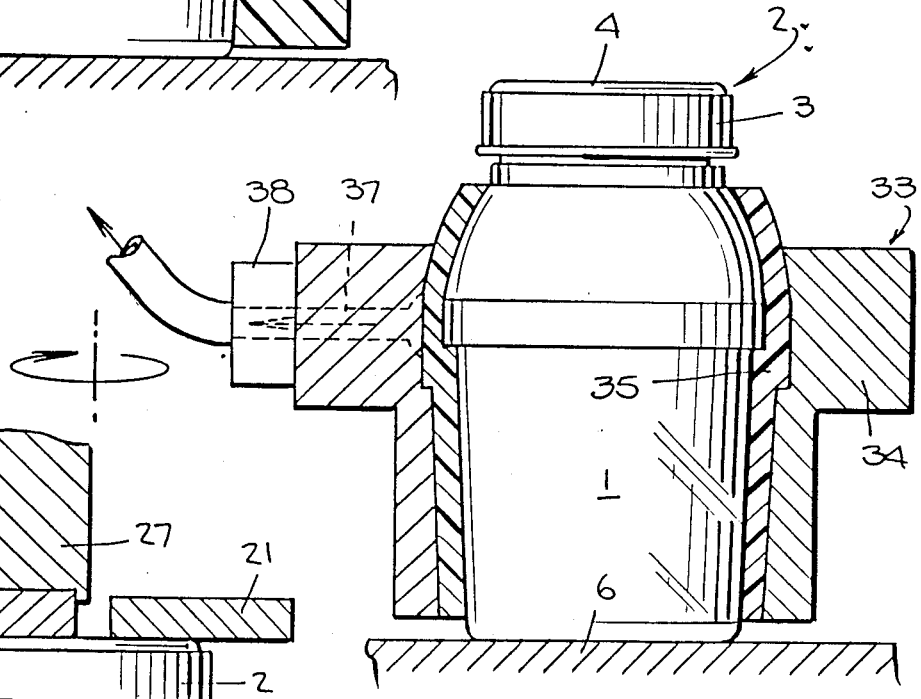
FIG. 10 is a vertical sectional view of another embodiment.
Figure 9:
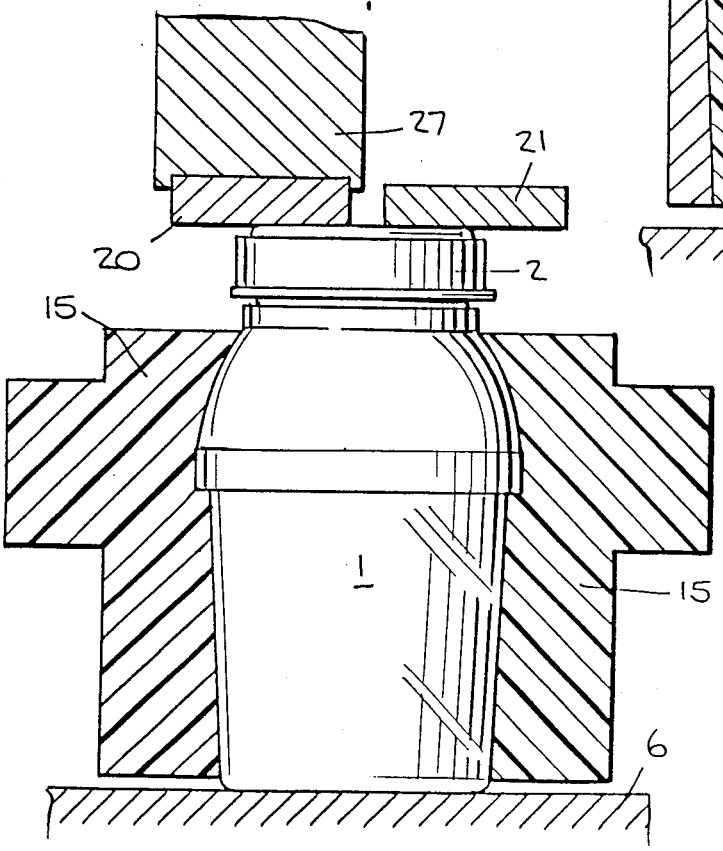

FIG. 10 illustrates another embodiment of a pocket 33 where an outer portion 34 of the pocket 33 is cast steel and the exact jar 1 shape is formed in a lining 35 which may be rubber or plastic.

The lining 35 may be porous so that source of vacuum which couples lining 35 through conduit 37 will exert a gripping force on the container 1 to assure the retention of or the desired reshaping of the container 1. The vacuum is applied to the pocket 33 at one or more locations through a suitable stationary manifold 38 making sliding contact with a moving surface of pocket 33.

The relatively thin-walled and easily and inexpensively manufactured containers 1 for which the above described side belt 7 is adapted are useful for products produced in enormous quantities so that a rapid sealing operation is desirable for the sealing machine. With each filled jar 1 firmly encapsulated as described, the improved high speed operation is performed by successively moving the jars 1 beneath the press on sealing means 9 whose belt 19 moves each cap a substantial distance down on the jar 1 and by then moving the partially sealed jar 1 beneath the cap twisting means 10 comprising a moving belt 20 and a drag shoe 21 (FIGS. 1 and 3) of the general type described in the above noted issued patents.

Thus, as illustrated in FIGS. 1 and 2, each jar 1 after receiving a cap 2 from the cap feed chute 8, is moved beneath the flat pressure plate 22, which is positioning for guiding the endless pressure belt 19 driven in synchronization with the conveyor 6 and the side belts 7 by a drive pulley 23. The plate 22 and the belt 19 are mounted on adjustable supports 24 on a hollow chamber 25 adjustably positioned above the conveyor belt 6.

The twist sealing means 10 is similarly mounted on the sealing machine chamber 25 on adjustable supports 26 and includes the stationary shoe 21 (FIGS. 1, 3 and 9) and the driven cap twisting belt 20 mounted on a second guide shoe 27. As the partially sealed cap 2 is moved under the sealing means 10, the stationary shoe 21 exerts a drag force on one side of the cap cover while the driven belt 20, which is moving faster than the jar 1, applies a sealing force in the opposite direction on a spaced portion of the cap 2. The combines action of the drag shoe 21 and the belt 20 cooperate to rotate the cap 1 a fraction of a turn and to move it to its finally sealed position on the jar 1 as illustrated in FIG. 10.

FIGS. 1, 4 and 5 illustrate a preferred embodiment of the cap applying chute 8. The chute 8 has a cap guide track 28 and means for positioning the endmost cap 1 at a moving jar 2 rim so that the endmost cap 1 is pulled from a chute 8 and loosely applied to the jar 1. Such stops are illustrated in the above noted issued patents. The chute 8 of the present invention includes an improved steam heating means best illustrated in FIGS. 4 and 5. This means comprises hollow chambers 29 and 30 surrounding the cap track 28 and nozzles or jets 31 and 32 on the top and bottom of the track 28 which direct heating steam both on to the outer cap 2 skirts and the lower and inner portions of the cap 2 skirts. The upper jets 31 are slanted to direct the steam against the cap flow and the lower jets 32 are shaped to direct the steam into the hollow caps 2 and in the direction of cap motion. This heating of the cap 2 skirts softens their thread portions and facilitates the above described press on and final twist on sealing.

Additionally, where tamper indicating bands are formed on the lower portion of the cap 2 skirts, this heating softens these bands and facilitates their movement over retention beads on the jars being sealed. Such tamper indicating means are illustrated, for example, in U.S. Pat. No. 4,299,328 dated Nov. 10, 1981.

It will be seen that an improved method and means has been provided which is particularly adapted for sealing thin-walled and relatively flexible containers at high sealing speeds. The method and means are adaptable to present straight line sealing machines with changes to the machine side belts, cap applying means and sealing means.

As various changes may be made in the form, construction and arrangement of the invention and with departing from the spirit and scope of the invention, and without sacrificing any of its advantages, it is to be understood that all matter herein is to be interpreted as illustrative and not in a limiting sense.

Having thus described my invention, I claim:

1. In a straight line sealing plastic machine for sealing jars with caps and having a jar conveyor for carrying jars successively past cap applying and cap sealing means, the improvement comprising:

side belt means with a plurality of pocket means mounted thereon and having cavities adapted for forming interior openings with a shape complimentary to the outside shape of the jars being sealed for substantially fully encapsulating the jars during their sealing.

2. The sealing machine as claimed in claim 1 in which said pocket means comprise plastic members.

3. The sealing machines as claimed in claim 1 in which said pocket means are metal and in which the cavities are lines with a non-metallic lining.

4. The sealing machine as claimed in claim 3 in which said lining comprises an elastomeric material.

5. The sealing machine as claimed in claim 3 in which said lining comprises plastic.

6. The sealing machine as claimed in claim 1 in which the pocket means cavities are quarter sections of the jar shape and four pocket means are combined to form one full jar shape.

7. The sealing machine as claimed in claim 1 in which the means for sealing comprises means for first pressing caps on and means for thereafter rotating the caps to a finally sealed position.

8. The sealing machine as claimed in claim 1 which further comprises means for heating at least the rim portion of the caps before sealing.

9. In a straight line sealing machine for sealing plastic jars with closure caps and having a jar conveyor for carrying jars successively past cap applying and cap sealing means, the improvement comprising:

side belt means with a plurality of pocket means mounted thereon having cavities adapted for forming jar encapsulating openings with a shape complimentary to substantially the entire side surfaces of the jars being sealed, cap applying means comprising an inclined and steam heated cap feeding chute for softening at least the rim portions of the caps, and sealing means comprising successive press-on means and cap rotating means providing downward force on the jars.

10. The sealing machine as claimed in claim 9 in which said pocket means comprise plastic members.

11. The sealing machine as claimed in claim 9 in which said pocket means comprise block members with cut-out end portions.

12. The sealing machine as claimed in claim 11 in which said block members comprise cut out sections which in combination provide a jar shaped cavity.

* * * * *